US008484853B1

(12) United States Patent
Laube

(10) Patent No.: US 8,484,853 B1
(45) Date of Patent: Jul. 16, 2013

(54) HAIR CUTTING DEVICE WITH VACUUM HAIR COLLECTION SYSTEM

(76) Inventor: Kim Laube, Thousand Oaks, CA (US)

( * ) Notice: Subject to any disclaimer, the term of this patent is extended or adjusted under 35 U.S.C. 154(b) by 0 days.

(21) Appl. No.: 11/215,555

(22) Filed: Aug. 29, 2005

(51) Int. Cl.
*B26B 19/44* (2006.01)

(52) U.S. Cl.
USPC ..... 30/133; 30/216

(58) Field of Classification Search
USPC ..... 30/123, 124, 133, 216; 15/300.1; D28/53
See application file for complete search history.

(56) References Cited

U.S. PATENT DOCUMENTS

| | | | | | |
|---|---|---|---|---|---|
| 1,528,430 | A | * | 3/1925 | Josten et al. | 30/133 |
| 1,549,839 | A | * | 8/1925 | Kuehne | 30/133 |
| 2,297,735 | A | | 10/1942 | Allen | |
| 2,697,876 | A | | 9/1952 | Blanchard | |
| 2,748,472 | A | | 6/1956 | Sheley | |
| 2,914,849 | A | * | 12/1959 | Watkins | 30/133 |
| 2,975,517 | A | * | 3/1961 | Brittain | 30/133 |
| 2,999,263 | A | * | 9/1961 | Smith | 30/133 |
| 3,073,026 | A | * | 1/1963 | Schaedler | 30/133 |
| 3,279,023 | A | * | 10/1966 | Zobel | 30/133 |
| 3,348,308 | A | | 10/1967 | Andis | |
| 3,353,265 | A | | 11/1967 | Mendoza | |
| 3,368,277 | A | * | 2/1968 | Ve Vea | 30/133 |
| 3,384,919 | A | | 5/1968 | Jording | |
| 3,440,681 | A | | 4/1969 | Hixson | |
| 3,505,732 | A | * | 4/1970 | Di Trapani | 30/133 |
| 3,979,825 | A | | 9/1976 | Baumann | |
| 4,030,196 | A | * | 6/1977 | Koiwa et al. | 30/133 |
| 4,077,122 | A | * | 3/1978 | Rollor et al. | 30/133 |
| 4,216,581 | A | * | 8/1980 | Van Slooten | 30/133 |
| 4,261,102 | A | | 4/1981 | Andriotis | |
| 4,314,405 | A | * | 2/1982 | Park | 30/133 |
| 4,573,267 | A | * | 3/1986 | Grohoski et al. | 30/133 |
| 4,628,601 | A | | 12/1986 | Van Slooten | |
| 4,667,405 | A | * | 5/1987 | Trichell et al. | 30/41.5 |
| 4,670,982 | A | * | 6/1987 | Kim | 30/133 |
| 4,679,322 | A | | 7/1987 | Hunts | |
| 4,704,794 | A | * | 11/1987 | Paradis | 30/133 |
| 4,706,326 | A | | 11/1987 | Romani | |
| 4,843,717 | A | * | 7/1989 | Crane | 30/133 |
| 4,868,984 | A | * | 9/1989 | Elsherbini | 30/133 |
| 4,970,787 | A | | 11/1990 | Watanabe | |
| 4,974,321 | A | * | 12/1990 | Yoshida | 30/133 |
| 5,031,320 | A | * | 7/1991 | Persyn | 30/133 |
| 5,075,971 | A | | 12/1991 | McCambridge | |
| 5,088,199 | A | | 2/1992 | Romani | |
| 5,142,786 | A | | 9/1992 | Hunts | |
| 5,153,994 | A | | 10/1992 | Emmett | |
| D337,176 | S | | 7/1993 | Romani | |
| 5,231,762 | A | * | 8/1993 | Hunts | 30/133 |
| 5,259,116 | A | * | 11/1993 | Laube | 30/216 |

(Continued)

FOREIGN PATENT DOCUMENTS

| | | | |
|---|---|---|---|
| DE | 4129810 | A1 * | 3/1993 |
| JP | 04338481 | A * | 11/1992 |
| WO | WO 8901393 | A1 * | 2/1989 |

*Primary Examiner* — Jason Daniel Prone
(74) *Attorney, Agent, or Firm* — Dennis W. Beech

(57) ABSTRACT

The present invention may be used for vacuum hair collection for a hair clipper. A conduit may be positioned in the clipper and may have a nozzle positioned adjacent to a cutting blade a forward end of the clipper. The conduit may have a rear opening at a rear end of the clipper. There may be a constriction section formed in the conduit adjacent the nozzle. The conduit may have a nondecreasing cross sectional interior dimension from the constriction section to the rear opening.

6 Claims, 3 Drawing Sheets

U.S. PATENT DOCUMENTS

| | | | | |
|---|---|---|---|---|
| 5,269,073 | A | 12/1993 | Johnson | |
| 5,377,411 | A * | 1/1995 | Andriotis | 30/133 |
| 5,623,764 | A | 4/1997 | Cseh | |
| 5,704,128 | A * | 1/1998 | Lin | 30/133 |
| 5,724,736 | A | 3/1998 | Smith | |
| 5,881,462 | A * | 3/1999 | Romani | 30/133 |
| 5,924,202 | A * | 7/1999 | Romani | 30/133 |
| 6,393,702 | B1 * | 5/2002 | Laube | 30/223 |
| 6,442,842 | B1 | 9/2002 | Parry | |
| 6,473,973 | B2 * | 11/2002 | Laube | 30/223 |
| 6,571,478 | B1 * | 6/2003 | Romani et al. | 30/133 |
| 6,684,511 | B2 * | 2/2004 | McCambridge et al. | 30/216 |
| 6,739,053 | B2 | 5/2004 | McCambridge | |
| 6,935,028 | B2 * | 8/2005 | Cutting | 30/41.5 |
| 6,978,547 | B2 * | 12/2005 | Degregorio, Jr. | 30/133 |
| 6,986,206 | B2 * | 1/2006 | McCambridge et al. | 30/133 |
| 7,010,859 | B2 * | 3/2006 | Laube | 30/223 |
| 7,076,878 | B2 * | 7/2006 | Degregorio, Jr. | 30/133 |
| D538,476 | S * | 3/2007 | Laube | D28/54 |
| 7,488,004 | B1 * | 2/2009 | Romani et al. | 30/133 |
| 8,225,512 | B2 * | 7/2012 | Coleman et al. | 30/133 |
| 8,359,755 | B1 * | 1/2013 | Laube | 30/199 |
| 2002/0108255 | A1 * | 8/2002 | Degregorio, Jr. | 30/133 |
| 2003/0101591 | A1 * | 6/2003 | Romani et al. | 30/133 |
| 2004/0006873 | A1 | 1/2004 | Cutting | |
| 2004/0055163 | A1 | 3/2004 | McCambridge | |
| 2006/0011028 | A1 * | 1/2006 | Andis et al. | 30/123 |
| 2006/0162516 | A1 * | 7/2006 | Andis et al. | 30/34.05 |
| 2006/0174487 | A1 * | 8/2006 | Andis et al. | 30/34.05 |
| 2006/0230619 | A1 * | 10/2006 | Williams et al. | 30/133 |
| 2008/0072437 | A1 * | 3/2008 | Michel | 30/201 |
| 2009/0277012 | A1 * | 11/2009 | Mikula et al. | 30/41.6 |
| 2010/0242286 | A1 * | 9/2010 | Yerke et al. | 30/133 |
| 2011/0185578 | A1 * | 8/2011 | Landrie et al. | 30/133 |

* cited by examiner

HAIR CUTTING DEVICE WITH VACUUM HAIR COLLECTION SYSTEM

BACKGROUND OF THE INVENTION

This invention relates to devices used to cut hair or groom animals that include a system to collect the hair cuttings. The new device with vacuum system incorporates in a forward portion of a vacuum conduit a constriction or choke location positioned to cause any tendency to clog due to cut hair entrainment volume or other conditions to occur at the constriction location.

Various hair collection systems for clippers may be known. However, the conduit or channel for conveying cut hair, usually by means of a vacuum, for such systems generally have one or more constrictions that may cause the conduit to become clogged when hair flow volume may become excessive. These constriction locations may be located in the conduit that may not be easily accessible to clear any clogged condition that may occur. A user may have to use a special tool or disassemble the clipper or vacuum conduit in order to clear a clogged condition.

SUMMARY OF THE INVENTION

The present invention is directed to a system for vacuum hair collection for a hair clipper. A conduit may be positioned in the clipper and may have a nozzle positioned adjacent to a cutting blade at a forward end of the clipper. The conduit may have a rear opening at a rear end of the clipper. There may be a constriction section formed in the conduit adjacent the nozzle. The conduit may have a nondecreasing cross sectional interior dimension from the constriction section to the rear opening.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
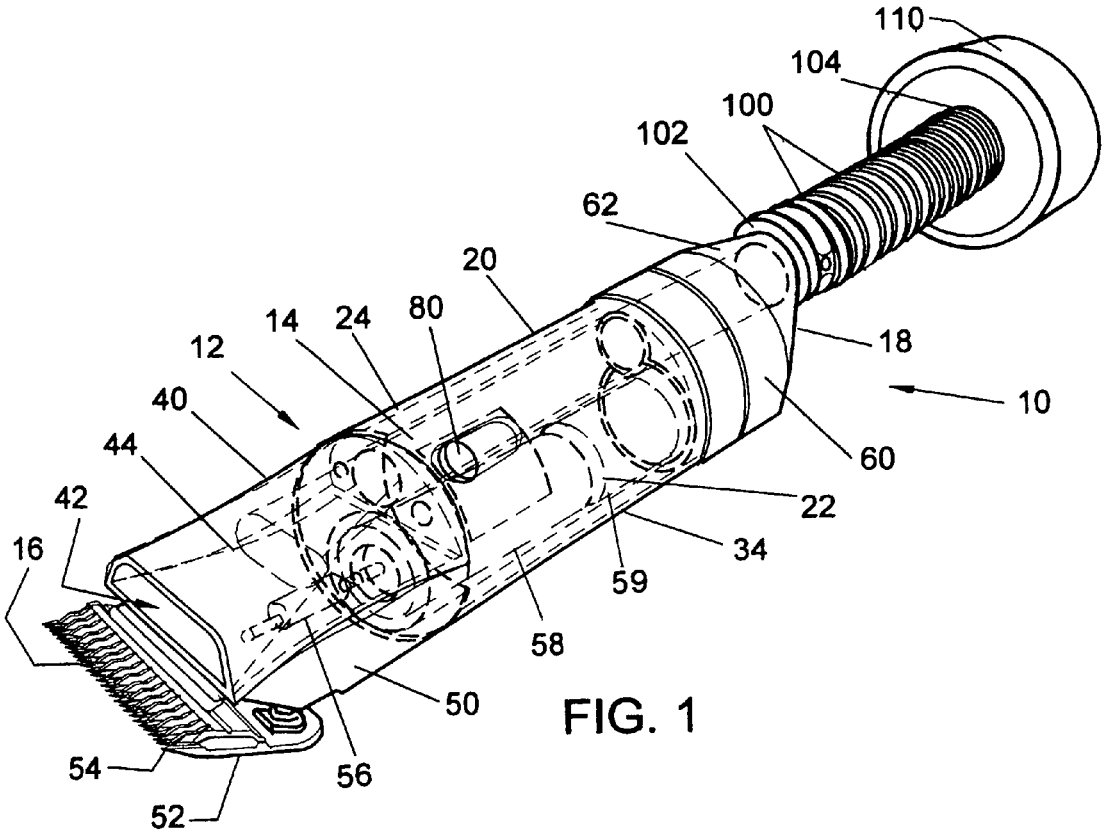
FIG. 1 illustrates a perspective view of the device according to an embodiment of the invention.

Referring to FIG. 1, a hair cutting device 10 may be a clipper 12 that may have a casing 20, a rear end closure 60, a front end housing 50 and a forward conduit element 40. The front end housing 50 may have a blade drive mechanism 56 disposed therein and the blade drive mechanism 56 may be engaged with a motor 58 that may be disposed in the casing 20. The front end housing 50 may support attachment of a cutting blade 52 for engagement with the blade drive mechanism 56. The motor may be connected to a battery 59 or other power source to power the clipper 12.

There may be a conduit 14 incorporated in the clipper 12 that may have a generally rectangular nozzle 42 at a forward end 16 and a rear opening 66 at a rear end 18. The conduit 14 may have multiple connected conduit elements 40, 24, 62. There may be a vacuum hose 100 attached at a first end 102 to the rear opening 66 and at a second end 104 to a vacuum source 110.

Figure 2:
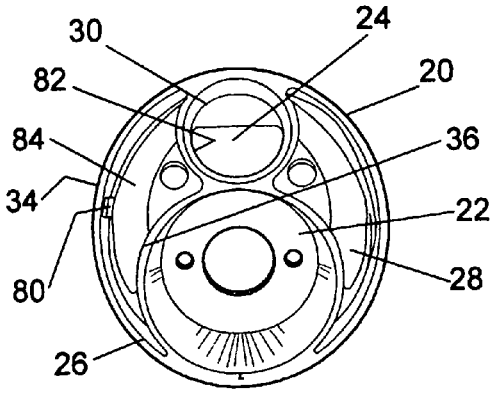
FIG. 2 illustrates a rear end view of a casing according to an embodiment of the invention.
Figure 3:
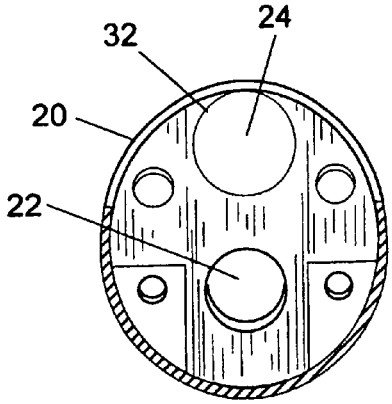
FIG. 3 illustrates a front end view of a casing according to an embodiment of the invention.
Figure 4:
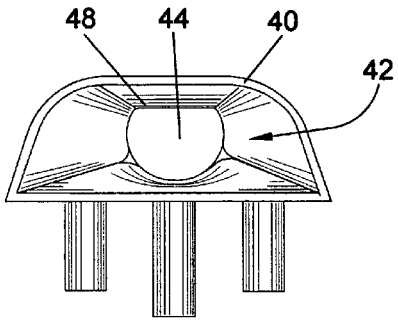
FIG. 4 illustrates a front end view of a forward conduit element according to an embodiment of the invention.
Figure 5:
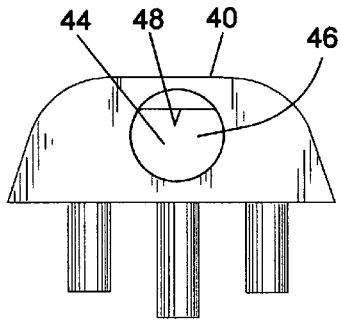
FIG. 5 illustrates a rear end view of a forward conduit element according to an embodiment of the invention.
Figure 6:
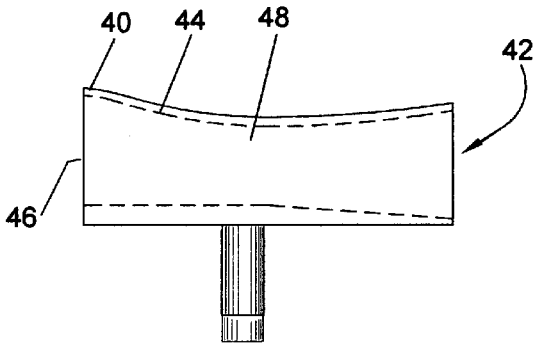
FIG. 6 illustrates a side view of a forward conduit element according to an embodiment of the invention.
Figure 7:
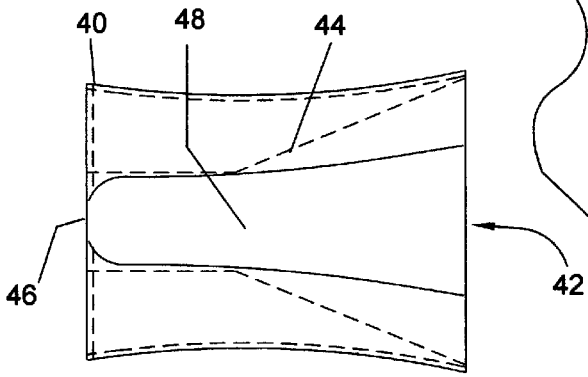
FIG. 7 illustrates a top view of a forward conduit element according to an embodiment of the invention.
Figure 8:
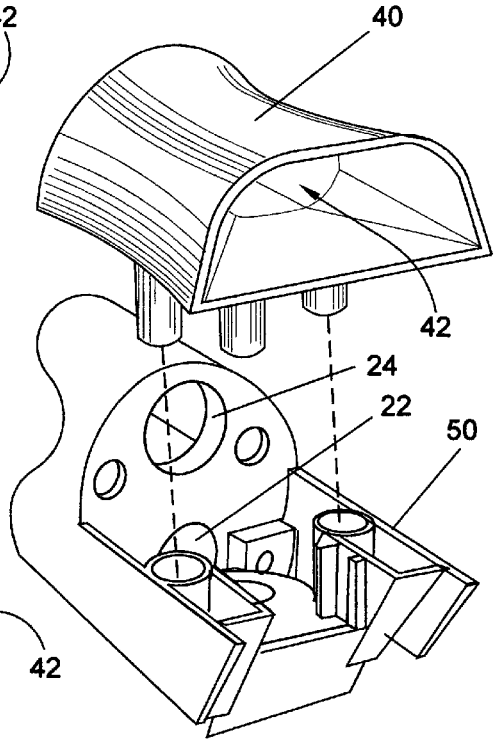
FIG. 8 illustrates a front perspective view of a portion of the casing and front end housing with the forward conduit element according to an embodiment of the invention.
Figure 9:
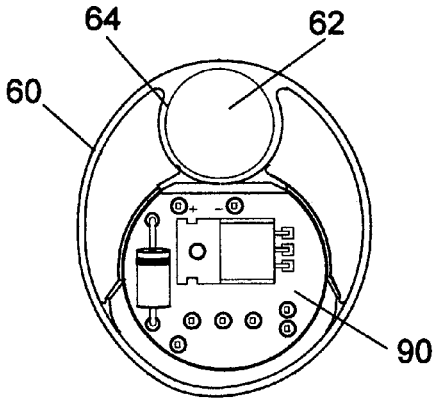
FIG. 9 illustrates a front end view of a rear end closure according to an embodiment of the invention.
Figure 10:
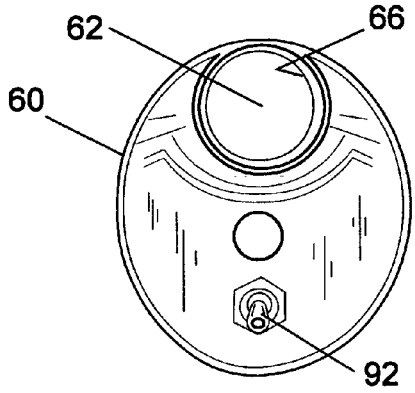
FIG. 10 illustrates a rear end view of a rear end closure according to an embodiment of the invention.

Referring to FIGS. 1 through 3, the casing 20 may be of generally cylindrical or tubular form and may have a slight oval cross sectional shape. This shape may facilitate manipulation of the clipper 12 in a users hand when cutting hair. Other cross sectional shapes, such as, generally rectangular, triangular or combinations of forms, may also be used. There may be a motor cavity 22 and a casing conduit 24 formed interior to the casing 20 that may be of approximately cylindrical form extending in the longitudinal axis of the casing 20. There may be two side cavities 26, 28 formed adjacent to the motor cavity 22 and casing conduit 24 interior to the casing 20. The casing conduit 20 may have a casing rear opening 30 and a casing forward opening 32. The casing conduit 24 may be a constant diameter circular conduit, rectangular cross section form or other shape that may have a constant cross sectional interior dimension along its length.

Referring to FIGS. 1 and 4 through 8, the forward conduit element 40 may have nozzle 42, forward conduit 44 and rear opening 46. The forward conduit element 40 may be attached to the front end housing 50 disposed for rear opening 46 to mate or join with casing forward opening 32. The nozzle 42 may be a generally rectangular opening and may be positioned rearwardly and aligned with the tip 54 of the cutting blades 52 of the clipper 12. The position of the nozzle 42 may allow ease in viewing the cutting blades 52 during use of the clipper 12. The flow of air caused by the vacuum condition in conduit 14 may have a cooling effect on the cutting blades 52 as well as flow through the casing over the motor cavity may have a cooling effect for a motor.

The forward conduit 44 may transition from a generally rectangular nozzle 42 to a generally circular conduit at rear opening 46. Intermediate the nozzle 42 and the rear opening 46 there may be a constriction section 48 that is the minimum cross-section interior dimension for the conduit 14. The constriction section 48 may be located at a distance from the nozzle 42 to facilitate a user using their finger to clear a collection of cut hair or conduit passage clog from the forward conduit 44.

Referring to FIGS. 1 through 3 and 9 through 10, a rear end closure 60 may be attached at casing rear end 19 of the casing 20. The rear end closure 60 may have a rear conduit 62 with a rear end forward opening 64 and a rear opening 66. The rear end forward opening 64 may mate with the casing rear opening 30 of the casing conduit 24. The rear end closure 60 may have provision for disposing of an electronic element 90 and an operating switch 92 for the clipper 12.

Figure 11:
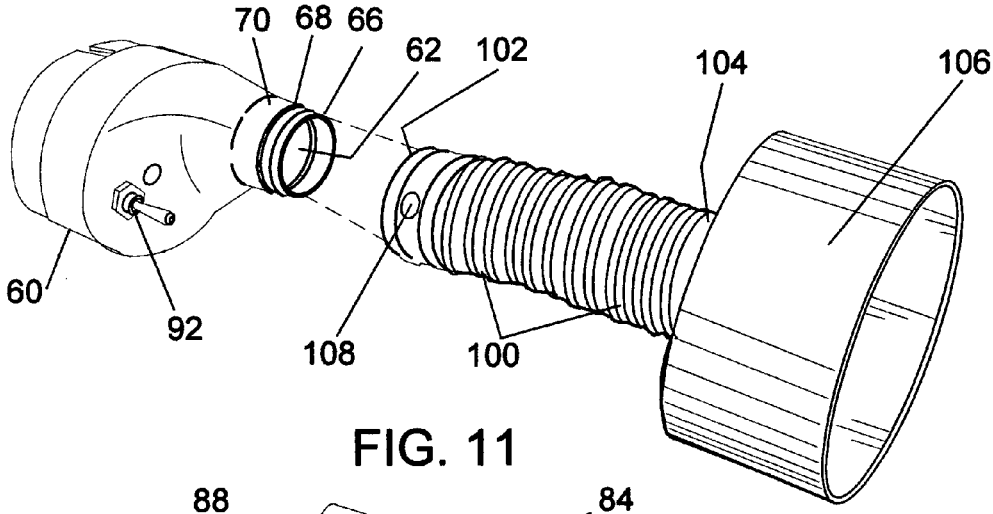
FIG. 11 illustrates a perspective view of a rear end closure and a vacuum hose according to an embodiment of the invention.

Referring to FIG. 11, the rear conduit 62 may have a groove 68 formed circumferentially in the wall 70 adjacent the rear opening 66. The vacuum hose 100 may have a ball detent hose connector 108 disposed adjacent to the first end 102 for use in attaching the vacuum hose 100 to the rear conduit 62. The vacuum hose 100 may also have a vacuum connector 106 attached to the second end 104 for attachment to a vacuum source.

Referring to FIG. 1, the casing conduit 24 and rear conduit 62 may be of equal and constant cross sectional interior dimension throughout their length to minimize the chance for clogging of the conduit. The vacuum hose 100 may be similarly sized to minimize the chance for clogging that may be caused by the volume of cut hair flow or hair composition. The casing conduit 24 and rear conduit 62 may have an expanding cross sectional interior dimension from the constriction section 48 rearward to the rear opening 66 that should have an inside dimension less than or equal to that of vacuum hose 100 first end 102. The casing conduit 24 should have a nondecreasing cross sectional interior dimension from the constriction section 48 to the rear opening 66. The constriction section 48 may facilitate any tendency to clog to occur in the forward conduit 44 that may be an accessible location for ease in clearing any clogging that may occur.

Figure 12:
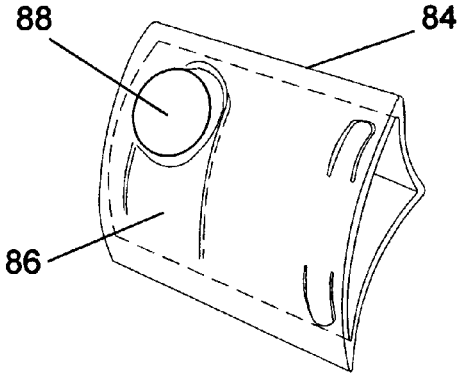
FIG. 12 illustrates a perspective view of a closure element according to an embodiment of the invention.

Referring to FIGS. 1, 2 and 12, there may be a vacuum relief port 80 formed in the outer wall 34 of the casing 20 that provides an outer opening to side cavity 26. There may also be an inner port 82 formed in the casing conduit wall between the side cavity 26 and the casing conduit 24. There may be a closure element 84 slidably inserted in side cavity 26 that may serve to open and close the vacuum relief port 80 and inner port 82 depending on the position of the closure element 84. The closure element 84 may be used to vary the vacuum conditions in the conduit 14. There may be a flexible tab 86 in closure element 84 that may have a protrusion 88 to engage vacuum relief port 80 that may be used to slide the closure element 84 and that may tend to define the length of slidably movement of the closure element 84.

While the invention has been particularly shown and described with respect to the illustrated embodiments thereof, it will be understood by those skilled in the art that the foregoing and other changes in form and details may be made therein without departing from the spirit and scope of the invention.

I claim:

1. A clipper device for cutting hair comprising:

a front end housing is attached to a casing at a forward end wherein said front end housing having a blade drive mechanism engagable with a cutting blade and engaged with a motor disposed in a motor cavity of said casing;

a casing conduit formed in said casing having a casing rear opening and a casing forward opening;

a forward conduit element having a forward conduit attached to said front end housing disposed for a nozzle of said forward conduit to be positioned rearwardly and aligned with a tip of said cutting blade and for a rear opening to mate with said casing forward opening;

a constriction section formed in said forward conduit adjacent said nozzle;

a rear end closure having a rear conduit attached at a rear end of said casing disposed for a rear end forward opening of said rear conduit to mate with said casing rear opening and said rear conduit having a rear opening;

said casing having a first side cavity formed adjacent to said motor cavity and said casing conduit interior to said casing;

an outer wall of said casing having a vacuum relief port therein communicating between the exterior of said outer wall and said first side cavity;

a casing conduit wall having an inner port therein communicating between said casing conduit and said first side cavity;

a closure element slidably inserted in said first side cavity disposed to be positioned to close and open said vacuum relief port; and an electrical power source connected to said motor.

2. The clipper device as in claim 1 wherein said closure element closes and opens said inner port in cooperation with opening and closing said vacuum relief port.

3. The clipper device as in claim 1 wherein said closure element having a tab with an outwardly disposed protrusion wherein said tab is disposed to position said protrusion in said vacuum relief port when said closure element is slidably inserted in said first side cavity.

4. The clipper device as in claim 1 wherein said casing having a second side cavity formed opposite said first side cavity adjacent to said motor cavity and said casing conduit interior to said casing.

5. The clipper device as in claim 1 further comprising:

a wall of said rear conduit having a groove formed in an exterior portion thereof adjacent to said rear opening;

a vacuum hose having a vacuum connector at a first end disposed intermediate said rear opening and a vacuum source wherein said first end attached to said rear opening by engagement of said vacuum connector in said groove and said vacuum hose at a second end attached to said vacuum source.

6. The clipper device as in claim 1 wherein said casing having an approximate cylindrical form.

* * * * *